United States Patent [19]

Müller et al.

[11] Patent Number: 4,478,681

[45] Date of Patent: Oct. 23, 1984

[54] FORGERY-PROOF PAPER

[75] Inventors: Friedhelm Müller, Odenthal; Horst Nickel, Leverkusen, both of Fed. Rep. of Germany

[73] Assignee: Bayer Aktiengesellschaft, Leverkusen, Fed. Rep. of Germany

[21] Appl. No.: 400,834

[22] Filed: Jul. 22, 1982

[30] Foreign Application Priority Data

Aug. 14, 1981 [DE] Fed. Rep. of Germany ..... 3132146

[51] Int. Cl.[3] ..... D21H 5/10

[52] U.S. Cl. ..... 162/140; 162/158; 427/7; 428/916

[58] Field of Search ..... 162/140, 158; 8/189; 427/7; 428/916

[56] References Cited

U.S. PATENT DOCUMENTS

| | | | |
|---|---|---|---|
| 2,061,632 | 11/1936 | Lenher | 162/140 |
| 2,075,538 | 3/1937 | Neff | 162/140 |
| 4,024,125 | 5/1977 | Kunstmann et al. | 260/157 |

FOREIGN PATENT DOCUMENTS

| | | | |
|---|---|---|---|
| 423046 | 1/1935 | United Kingdom | 162/140 |
| 1425881 | 2/1976 | United Kingdom . | |
| 1439158 | 6/1976 | United Kingdom . | |

OTHER PUBLICATIONS

Translation of German Pat. No. 270,861.

Translation of German patent specification No. DE-PS92011.

*Primary Examiner*—Peter Chin

*Attorney, Agent, or Firm*—Sprung Horn Kramer & Woods

[57] ABSTRACT

Forgery-proof paper, which exhibits a distinct coloration when treated with an oxidizing agent and, if appropriate, a reducing agent, contains, as the reagent, a compound of the formula

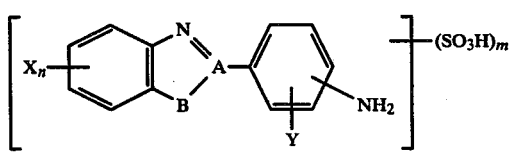

I wherein

A represents N or C,

B represents NR, O or S,

R represents hydrogen or alkyl,

X and Y represent hydrogen or customary substituents and n and m represent the numbers 1 or 2.

2 Claims, No Drawings

FORGERY-PROOF PAPER

There is considerable interest in protecting a number of special papers, such as, for example, those used for banknotes, securities, identity papers and documents, against forgeries. In particular, it is intended to protect papers of this type against the removal, by erasure, of handwriting which has been executed, for example, using ink.

The patent literature has described a relatively large number of possibilities for making the erasure with acids, caustic alkalis, oxidising agents, reducing agents and organic solvents difficult by the fact that coloured substances are formed during this treatment. Most of the proposed substances react to alkali, acid or chlorine (see, for example U.S. Pat. No. 4,037,007, U.S. Pat. No. 3,437,555 or French Patent Specification No. 2,365,656).

A customary method of forgery uses a strong oxidising agent as well as a reducing agent, such as, for example, the potassium permanganate/sodium bisulphite system-preferably in the acid range. Potassium permanganate decolourises ink rapidly and completely; the manganese dioxide formed on the paper during the process is subsequently rendered colourless with bisulphite. Erasing fluids based on these substances are commercially available in the form of ready-to-use solutions in dabbing bottles (for example "Ink Eradicator Les Siamoises X 2", I. Herbin S.A., Paris).

Protection against this method of forgery is particularly difficult, since a substance is required which is colourless and becomes distinctly coloured with permanganate, but which cannot be decolourised again with bisulphite.

It has now been found that even this method of forgery has no chance of remaining undiscovered when a paper is used which contains, as the reagent, a colourless compound of the formula

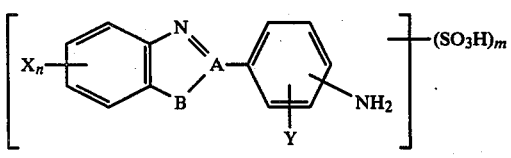

(I)

or salts thereof, wherein

A represents N or C,

B represents NR, O or S,

R represents hydrogen or alkyl,

X and Y represent hydrogen or substituents customary in the chemistry of paper colorants, and n and m represent the numbers 1 or 2, and wherein the amino group is located in the m-position or p-position to A.

Suitable salts are, in particular, the alkali metal salts and alkaline earth metal salts, preferably the Na, K, Li, Mg, Ca or ammonium salts.

Suitable alkyl radicals R are those which have 1–4 C atoms and are optionally substituted, for example by OH, CN, phenyl or $C_1$–$C_4$-alkoxy.

Suitable substituents X and Y are—in addition to H—for example, $C_1$–$C_4$-alkyl, $C_1$–$C_4$-alkoxy, Cl, $CF_3$ or CN. H, $CH_3$, Cl and $OCH_3$ are preferred.

Preferred compounds are those of the formula I, wherein

A represents C,

B represents NH, N—$C_1$–$C_4$-alkyl or S,

X represents H, Cl, $CH_3$ or $OCH_3$,

Y represents H or $CH_3$ and n and m represent 1 or 2.

The following may be mentioned as examples: 2-(4'-aminophenyl)-6-methyl-benzothiazole-7-sulphonic acid (='dehydrothio-p-toluidinesulphonic acid), 2-(4'-amino-3'-sulphonylphenyl)-6-methyl-benzothiazole, 2-(4'-amino-3'-sulphonylphenyl)-6-methyl-benzothiazole-7-sulphonic acid, 2-(4'-amino-3'-tolyl)-4,6-dimethyl-benzothiazole-7-sulphonic acid, 5-methyl-2-(4'-aminophenyl)-benzimidazole-6-sulphonic acid, 5-methyl-2-(3'-aminophenyl)-benzimidazole-6-sulphonic acid, 2-(4'-aminophenyl)-benzotriazole-5-sulphonic acid and 2-(3'-sulphonyl-4-aminophenyl)-benzotriazole.

These compounds are known (see, for example German Patent Specifications Nos. 92,011, 270,861, 2,302,522, 2,329,126, 2,421,822 and 2,716,503) or are readily obtainable by methods which are in themselves known.

Production of the paper according to the invention is effected in such a manner that the compounds of the formula (I) are applied, during or after the manufacture of the paper, by addition at the pulp stage or by application onto the surface of the paper or by an appropriate surface treatment.

In general, these compounds are employed in the form of aqueous solutions of their readily soluble salts, in particular alkali metal salts.

Although the solutions are slightly yellow coloured in concentrated form, they become virtually colourless when diluted below approx. 1%. If, according to a preferred production variant, the dilute solutions, alone or in combination with a binder, are applied onto white paper, the appearance of the paper remains virtually unchanged.

Examples of suitable binders are solutions of starch or carboxymethylcellulose or even anionic plastic dispersions, for example those based on polymers of butadiene and styrene or acrylic acid esters, and polyvinyl alcohol solutions.

The paper is normally sized at the pulp stage, for example with resin size. However, the sizing of the paper pulp can also be completely or partially omitted, and the antiforgery reagent can be combined with an anionic surface-sizing agent, possibly also using starch at the same time. By this means, the solution of the reagent is able to penetrate the paper more deeply, and the sizing required to enable the paper to be written upon is achieved simultaneously with the finishing. Suitable surface-sizing agents are commercially available products, for example aqueous solutions or dispersions based on copolymers of maleic anhydride or ammonium salts thereof.

The paper treated with the compounds of the formula (I) becomes distinctly yellow when dabbed with a dilute potassium permanganate solution, and also remains yellow when the dark brown manganese oxides formed on the paper are decolourised with a dilute solution of sodium bisulphite.

Depending on the absorptive power of the paper, a surface treatment with 0.01 to 0.5% strength solution of the antiforgery reagent is required to achieve a distinctly visible yellow colouration.

In principle, the reagent can also be added to the paper pulp (that is to say, the paper fibre suspension). In this case, however, it must be taken into account that part of the product passes into the waste water during the production of the paper. By the addition of aluminium sulphate or of cationic retention or fixing agents (for example those based on polyacrylamide, polyamideamine or dicyanodiamide/formaldehyde) the yield in the paper can, however, be improved. In general, 0.1–5% of reagent (relative to the paper pulp) is required for this production variant.

EXAMPLE 1

A paper composed of bleached sulphate cellulose and sized at the pulp stage with resin lime and aluminium sulphate was treated with a 0.25% strength aqueous solution of "dehydrothio-p-toluidinesulphonic acid" in a laboratory size press (System Werner Mathis AG, Niederhasli/Switzerland). This solution was prepared by a process in which 0.25 g of the product was stirred into 100 ml of water, and was brought into solution by the dropwise addition of dilute sodium hydroxide solution. Instead of sodium hydroxide solution, potassium hydroxide solution or lithium hydroxide solution can also be used.

The paper was dried on a hot cylinder at 100° C. It did not differ in appearance from the untreated paper.

On application of a spot of a dilute solution of potassium permanganate and subsequent application of a dilute sodium bisulphite solution onto the paper finished in this manner, a very distinct, permanent yellow colouration was formed.

EXAMPLE 2

The surface of an unsized paper which was composed of bleached cellulose and in the preparation of which 1% of aluminium sulphate had been added to the paper pulp was treated, in a laboratory size press (System Werner Mathis AG, Niederhasli/Switzerland), with a 5% strength starch solution which contained 1% of a commercially available anionic surface-sizing agent based on a styrene/maleic anhydride copolymer. 0.2% of dehydrothio-p-toluidinesulphonic acid in the form of a 1% strength solution in dilute sodium hydroxide solution was added to this size press liquor.

In this manner, the surface of the paper was sized and at the same time the paper was finished with the antiforgery reagent.

On application of a spot of a dilute solution of potassium permanganate and subsequent application of a dilute sodium bisulphite solution onto the paper finished in this manner, a very distinct, permanent yellow colouration was formed.

EXAMPLE 3

1% of dehydrothio-p-toluidinesulphonic acid (relative to the weight of the dry fibres), in the form of a 1% strength solution in dilute sodium hydroxide solution, was added to a suspension of 1% of bleached sulphate cellulose (freeness approx. 35° SR) in water, while stirring. 2% of resin size and 3% of aluminum sulphate were then added, and the mixture was stirred for 10 minutes.

The fibre suspension was diluted to 0.3% with water and sucked off over a laboratory sheet-forming apparatus, and the paper sheets formed were dried at approx. 100° C.

The paper had a slight yellowness which was hardly disturbing in practice, and became yellow when spotted with permanganate solution and subsequently with bisulphite solution.

We claim:

1. Forgery-proof paper which exhibits a distinct colouration when treated with an oxidising agent and, if appropriate, a reducing agent, characterized in that it contains, as the reagent, a compound of the formula

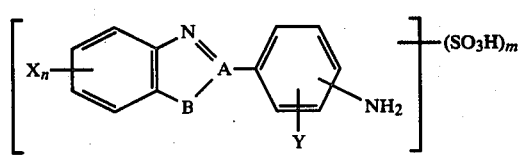

(I)

or a salt thereof, wherein

A represents C,

B represents S,

R represents hydrogen or alkyl,

X represents H, Cl, $CH_3$ or $OCH_3$,

Y represents H or $CH_3$, n represents the numbers 1 or 2, and m represents the number 2, and wherein the amino group is located in the m-position or p-position to A.

2. Forgery-proof paper according to claim 1, characterised in that it contains the reagent in the form of the alkali metal salts.

* * * * *